350-357 SR
8/16/83 XR 4,399,436

United States Patent [19]

Hamada et al.

[11] 4,399,436

[45] Aug. 16, 1983

[54] ELECTROCHROMIC DISPLAY DEVICES

[75] Inventors: Hiroshi Hamada, 33-104 Higashikidera-cho 1-chome, Nara-shi, Nara-ken, Japan; Kohzo Yano, Yamatokoriyama, Japan; Katubumi Koyanagi, Nara, Japan; Hiroshi Take, Ikoma, Japan; Yasuhiko Inami, Nara, Japan

[73] Assignee: Hiroshi Hamada, Osaka, Japan

[21] Appl. No.: 268,410

[22] Filed: May 29, 1981

[30] Foreign Application Priority Data

May 30, 1980 [JP] Japan ..... 55-73915

[51] Int. Cl.[3] ..... G09G 3/16

[52] U.S. Cl. ..... 340/812; 340/763; 340/785; 350/357

[58] Field of Search ..... 340/763, 785, 812; 350/357

[56] References Cited

U.S. PATENT DOCUMENTS 4,175,836 11/1979 Redman et al. ..... 340/785 X 4,229,080 10/1980 Take et al. ..... 350/357

*Primary Examiner*—David L. Trafton

*Attorney, Agent, or Firm*—Birch, Stewart, Kolasch & Birch

[57] ABSTRACT

An electrochromic display device comprises a plurality of display segmented electrodes and first additional electrodes, a layer of an electrochromic material in contact with each of the display segmented electrodes and the first additional electrodes, a first connecting circuit for selectively connecting each of the display segmented electrodes into one of two groups, depending on a display pattern to be indicated, a counting circuit for counting the electrodes and determining the difference in display area between the two groups of display segmented electrodes, a circuit responsive to the difference in display area for connecting each of the first additional electrodes into one of the two groups of the display segmented electrodes, a power supply for supplying power to each of the two groups of the first additional electrodes and the display segmented electrodes, and a second additional electrode for keeping the total amount of charge for coloring all the display electrodes constant.

7 Claims, 3 Drawing Figures

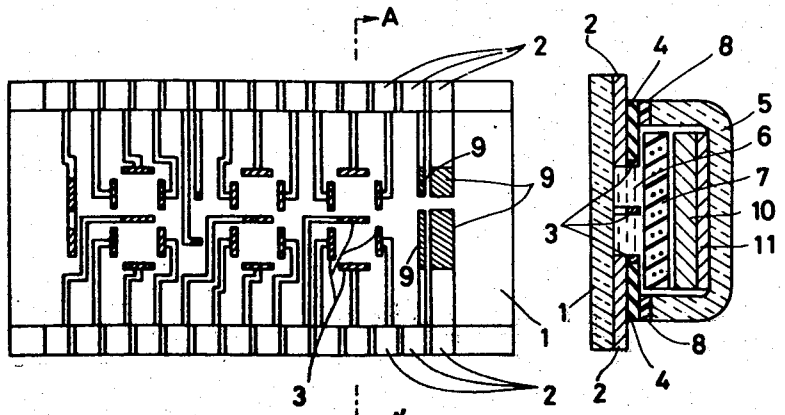
FIG. 1
FIG. 2
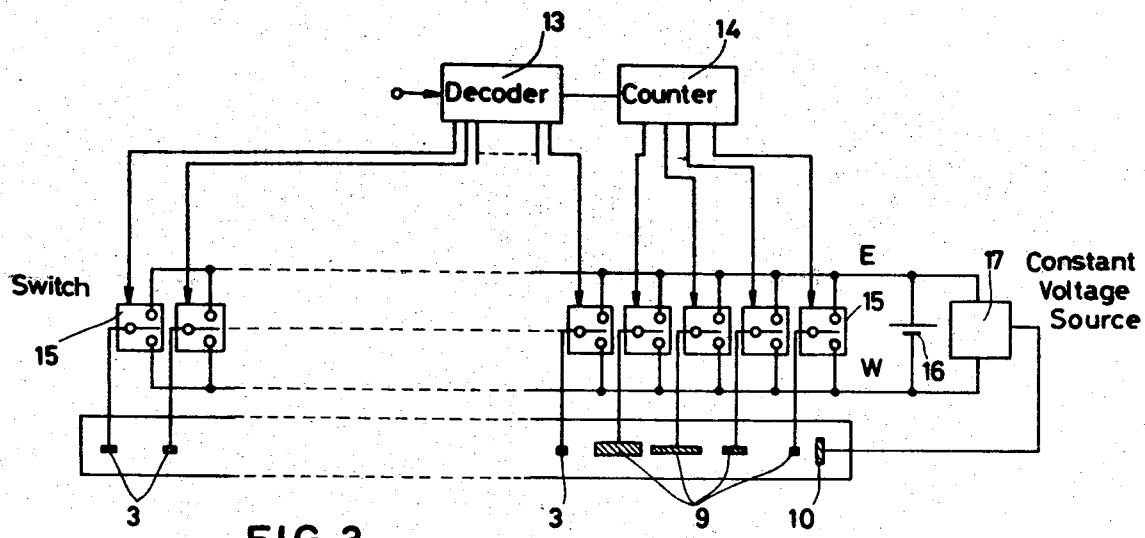
FIG. 3

ELECTROCHROMIC DISPLAY DEVICES

BACKGROUND OF THE INVENTION

1. Field of the Invention

The present invention relates to electrochromic display devices using an electrochromic material such as $WO_3$, $MoO_3$, viologen etc. and, more particularly, to a construction and a driving method for such electrochromic display devices.

2. Description of the Prior Art

Japanese Published Unexamined Patent Application No. 53-17090 published Feb. 16, 1978 discloses the so-called charge transfer driving system characterized in that erasing voltage is applied to one or more colored display electrodes made of an electrochromic material, the amount of charge of the erasing voltage corresponding to a coloration depth of the colored display electrodes, and in that no current flows after completion of erasure so as to prevent further application of charge. By virtue of this function, however, any voltage is applied to a plurality of charges for coloration of all the display electrodes is intended to be kept constant as long as the applied voltage is less than a voltage which would cause an undesirable reaction such as resolution of the electrolyte, etc.

However, it has been difficult to accurately keep the total amount of charge for coloration constant, particularly, under an elevated temperature, so that the total amount reduced to thereby make coloration depth of the display electrodes faint, gradually.

SUMMARY OF THE INVENTION

Accordingly, it is an object of the present invention to provide an improved electrochromic display showing stable coloration depth of display electrodes.

It is another object of the present invention to provide an improved electrochromic display keeping a total amount of charge for coloration of display electrodes constant for a long time.

It is a further object of the present invention to provide an improved electrochromic display comprising an additional electrode consisting of an active material.

Briefly described, an electrochromic display device of the present invention comprises a plurality of the display segmented electrodes and the first additional electrodes, a layer of an electrochromic material in contact with each of the display segmented electrodes and the first additional electrodes, first connecting means for selectively connecting each of the display segmented electrodes into one of two groups, depending on a display pattern to be indicated, counting means for counting the display segments and determining the difference in display area between the two groups of display segmented electrodes, means responsive to the difference in display area for connecting each of the first additional electrodes into one of the two groups of the display segmented electrodes, power supply means for supplying power to each of the two groups of the first additional electrodes and the display segmented electrodes, and a second additional electrode for keeping a total amount of charge for coloring all the display electrodes constant.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 1 shows a plan view of an electrochromic display cell according to the present invention;

FIG. 2 shows a cross-sectional view of the display cell, taken along line A—A' of FIG. 1; and FIG. 3 shows a block diagram of a driver for driving the display cell of FIG. 1.

DESCRIPTION OF THE INVENTION

Reduction of a total amount of charge for coloration of display electrodes is believed to occur because impurities in an electrolyte and oxygen resolved therein oxidize coloration seeds to thereby bleach them. The total amount of charge for coloration is kept constant by provision of a second additional electrode according to the present invention.

The second additional electrode is prepared by using an active material selected from the following groups:

(1) The first kind of electrode:

Mg, Al, Zn, Cr, Fe, Ni, Sn, Pb, Tl, Ti, Zr, Cd, In in which an electrolyte is selected to be a solution consisting of an acid, a salt dissolved in a solvent such as water or an organic solvent, and a solution of KCl, or the like, typically, a solution of lithium perchlorate in $\gamma$-Butyrolactone, or sulphuric acid.

(2) The second kind of electrode:

a halogenide of a metal, sulfate, nitrate, perchloric acid, preferably, $NiF_2$, $NiCl_2$, $CuF_2$, $CuCl_2$, AgCl (3) homogeneous phase redox system:

an oxide, sulfide or selenide of a metal, preferably, $WO_3$, CuS, CuSe, FeS, FeSe, MoOx, WOx (in which x is more than 1 and not more than 3), tungsten bronze, and $Nb_2Ox$ (x is more than 2 and not more than 5).

(4) heterogeneous phase redox system:

RFe(II) [Fe(III) $(CN)_6$] (in which R stands for $NH_4$, H, K or Na), i.e., Prussian blue, a metallophthalocyanine complex, an iron complex, a cobalt complex, or another transition metal complex.

A single compound is usually used, but it is also possible to use a mixture of two or more compounds if required.

The above-named materials for the second additional electrode provide the following advantages:

(1) No high overpotential is shown:

If high overpotential shows, it leads to a disadvantage that a value of a voltage applied to the second additional electrode could become high.

(2) It permits flow of a stable current for a long period.

(3) Even if a production is made as a result of a reaction, it does not damage the display electrodes or so.

Referring now to FIGS. 1 and 2, an electrochromic display cell of the present invention comprises a transparent front substrate 1, a transparent and conductive film 2, and a layer of an electrochromic material 3. The film 2 is disposed on the substrate 1. The layer 3 is formed as a display electrode or segment. An insulating film 4 is formed on the remaining portion, except for the display electrodes, of the film 2. Together with the thus prepared front substrate 1, another substrate 5 forms a cavity having an electrolyte 6 and an opaque background material 7 therein.

For this purpose, the two substrates are bonded to each other with any spacer means. Alternatively, the substrate 5 may be shaped like a cap as indicated in FIG. 2.

A first additional electrode 9 is formed on the substrate 1, in which case the electrode 9 is prepared simultaneously with the display segments 3. Alternatively, the electrode 9 may be disposed on the substrate 5.

When the electrode 9 is formed on the substrate 1, a disadvantage is that portions of substrate 1 are dead area not available for display. An advantage is that when no electrode need be formed on substrate 5 the variety of materials from which substrate 5 may be formed is expanded, thereby minimizing manufacturing cost.

When the electrode 9 is formed on the substrate 5, an advantage is to minimize the dead area on substrate 1 as much as possible. Additionally, in such case it is unnecessary to form the first additional electrode with transparent material and any inert metal can be used for the first additional electrode.

Regardless of whether the first additional electrode 9 is formed on the substrate 1 or the substrate 5, a layer of electrochromic material which is the same as that for the display electrode is disposed on the first additional electrode to show identical electrochemical properties with those of the display electrode.

As a feature of the present invention, a second additional electrode 10 is formed as a film which is prepared by evaporation, sputtering or the like. It comprises a lower electrode 10 made of any inert metal. The lower electrode 10 is disposed on the substrate 5. Any metal material selected from group (1) set forth above can be used for this purpose.

Alternatively, the second additional electrode may be prepared by the pressure molding of a mixture of a powder of a solid redox type active material and another powder of a conductor.

The powder of a conductor for use according to this invention may be carbon, more specifically expanded graphite, active carbon, graphite or carbon black. Expanded graphite or active carbon is particularly preferable.

A powder of a solid oxidation-reduction active material and that of a conductor have a mixing ratio by weight in the range of 1:0.8 to 100, and more preferably 1:1 to 20. These powders preferably have a grain size not greater than 300 mesh in accordance with the Japanese Industrial Standards. The application of pressure may be effected by a hydraulic press having a capaciaty of, for example, 5 tons/cm$^2$, or by rolling to form a plate.

The powder of the conductor may be expanded graphite (E×P−200 of Nippon Graphite, Japan), or active carbon (Merck & Co., Inc.). The thus formed plate is interposed as the second additional electrode 10 between the counter substrate 5 and the opaque background material 7.

To electrically communicate the second additional electrode 10 with an external driving circuit, a film 11 is formed on the counter substrate 5 to make a leading conductor and terminals. The film may be prepared by evaporation or the like. To make the leading conductor 11 and the terminals, external conductors may be inserted within the powder when the hydraulic pressure is applied. The conductor may be metallic wiring, carbon fiber or the like.

FIG. 3 shows a block diagram of a driving circuit for driving the above-described electrochromic display cell. The driving circuit enables the so-called charge transfer driving in which a constant voltage is applied between display electrodes to be colored and display electrodes to be erased.

More particularly, among a certain number of display electrodes or segments, some of the display segments are colored and others of the display segments are erased by applying a constant voltage between those colored and the others to transfer charge from the other segments for erasure to the segments for coloration.

The driving circuit of FIG. 3 comprises a decoder 13 for decoding display information, a counter 14 for counting the number of display segments to be colored, a plurality of switches 15 each operating a display segment 3 or a first additional electrode 9, a constant voltage source 16 for driving the display segments 3 and the first additional electrodes 9, and another constant voltage source 17 for driving the second additional electrode 10.

The area of each display electrode 3 is assumed to be "1", and it is preferable that the areas of the respective first additional electrodes 9 are "1", "2", "4", and "8". The area of the second additional electrode 10 is not limited to a certain amount and it is sufficient for the electrode 10 to occupy a small area such as "1".

According to the charge transfer driving system of the present invention, the total of the area of colored segments and colored additional electrodes is kept constant. No counter electrode opposite to any display electrodes is incorporated in this type of electrochromic display cell. The counter electrode is used always to color any display electrode. The additional electrodes of the present invention are used as necessary depending upon the number of colored display electrodes.

The driving circuit of FIG. 3 comprises a plurality of the display segmented electrodes and the first additional electrodes, a layer of an electrochromic material in contact with each of the display segmented electrodes and the first additional electrodes, first connecting means for selectively connecting each of the display segmented electrodes into one of two groups, depending on a display pattern to be indicated, counting means for counting electrodes in the groups and thereby determining the difference in display area between the two groups of display segmented electrodes, means responsive to the difference in display area for connecting each of the first additional electrodes into one of the two groups of the display segmented electrodes, power supply means for supplying power to each of the two groups of the first additional electrodes and the display segmented electrodes, and a second additional electrode for keeping the total amount of charge for coloring all the display electrodes constant.

Operations in the circuit elements of the circuit of FIG. 3 are summarized in the following table.

| Display | 1 | 2 | 3 | 4 | 5 | 6 | 7 | 8 | 9 | 0 |
|---|---|---|---|---|---|---|---|---|---|---|
| Segment (Area Ratio:1) | | | | | | | | | | |
| a | x | o | o | x | o | o | o | o | o | o |
| b | o | o | o | o | x | x | o | o | o | o |
| c | o | x | o | o | o | o | o | o | o | o |
| d | x | o | o | x | o | o | x | o | o | o |
| e | x | o | x | x | x | o | x | o | x | o |
| f | x | x | x | o | o | o | o | o | o | o |
| g | x | o | o | o | o | o | x | o | o | x |
| segment total | 2 | 5 | 5 | 4 | 5 | 6 | 4 | 7 | 6 | 6 |
| additional (h) | | | | | | | | | | |

-continued

| Display | 1 | 2 | 3 | 4 | 5 | 6 | 7 | 8 | 9 | 0 |
|---|---|---|---|---|---|---|---|---|---|---|
| electrode 9 | | | | | | | | | | |
| Area Ratio 1 | o | x | x | o | x | o | o | x | o | o |
| Area 2 (i) | x | o | o | o | o | x | o | x | x | x |
| Area 4 (j) | o | x | x | x | x | x | x | x | x | x |
| additional electrode 9 | | | | | | | | | | |
| total | 5 | 2 | 2 | 3 | 2 | 1 | 3 | 0 | 1 | 1 |
| total | 7 | 7 | 7 | 7 | 7 | 7 | 7 | 7 | 7 | 7 |

In the table, the circle indicates that a particular display electrode segment is illuminated by connecting it with the negative terminal of the first constant voltage source 16 through one of the respective switches 15. The "X" mark indicates that a particular electrode or a first additional electrode is not illuminated by connecting it with the positive terminal of the source 16 through one of the respective switches 15. In the table, a symbol to be indicated is assumed to be one digit comprised of colored electrodes and erased electrodes totalling 7.

When a particular display symbol is to be changed, exemplary circuit operation is as follows:

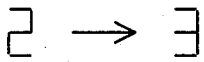

(i)

The number of display electrodes to be colored (5) is identical in each case so that condition of the first additional electrodes is unchanged. Display segments, a, b, d, e and g and a first additional electrode i having an area ratio of 2 are initially connected to the negative voltage to maintain coloration. Display segments c and f, and first additional electrodes h (area ratio:1) and j (area ratio:4) are connected to the positive voltage to maintain erasure.

Display segment c should be changed from erasure to coloration and display segment e should be changed from coloration to erasure. In

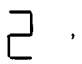

display segment c is coupled to the positive voltage to provide erasure. In

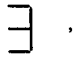

it should be coupled to the negative voltage by changing its associated switch 15.

Display segment e is coupled to the negative voltage in

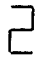

to provide coloration. In

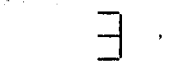

it should be coupled to the positive voltage by switching the switch 15. When these operations are performed simultaneously, charge condensed in display segment e is transmitted to display segment c to enable the display change.

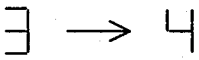

(ii)

Display segments b, c and g continue to be coupled to the negative voltage to maintain coloration. Display segment e continues to be coupled to the positive voltage to maintain erasure. Display segments a and d must be erased while display segment f must be colored. Only 4 segments remain colored. To account for this difference, the charge from a single display segment is transmitted to a first additional electrode h (area ratio:1) so that the additional electrode h is changed to be colored. Thus, the total number of display segments and additional electrodes to be colored is kept constant. Each of the display segments a and d is turned to be coupled to the positive voltage while f is turned to be coupled to the negative voltage.

Throughout these operations, the second additional electrode 10 functions to supply with charge any of the display electrodes 3 and the first additional electrodes 9 to be colored. The second constant voltage source 17 is provided for dividing the voltage of the source 16 to obtain a medium voltage between the positive voltage and the negative voltage of the source 16. The medium voltage is applied to the second additional electrode 10.

It may be possible for each of the first additional electrodes 9 to possess the same area ("1"). If they have respective areas of "1", "2", "4" and "8", this is advantageous to reduce the number of additional electrodes and the switches 15. If only a digit is used, it may be possible to provide area ratio of 1:2:2.

When a display of

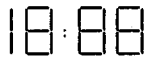

is employed as in a timepiece, the maximum number of the colored display segments is 21 as in a display of

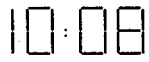

and a minimum number is 6 as in a display of

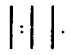

The difference is 15 so that four additional electrodes of areas 1:2:4:8 is sufficient.

When using the above-described driving system, little reduction of coloration depth of the colored display electrodes is observed even when the display cell is driven continuously within an oven at an elevated temperature of about 60° C. for a period exceeding 1 month.

Preferably the capacity of the constant voltage source 17 applied to the second additional electrode 10 should be about 0 to about 1.5 V. When the second additional electrode 10 is prepared by using a material selected from group (1) in particular, Mg, Al, Zn, Pb, Tl, Cd and In, it is sufficient to supply the second additional electrode 10 with no voltage. In such a case, the second constant voltage source 17 can be omitted and the second additional electrode 10 is directly coupled to the negative terminal of the first constant voltage source 16.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electrochromic display device comprising:

a plurality of display segmented electrodes and first additional electrodes;

a layer of an electrochromic material in contact with each of the display segmented electrodes and the first additional electrodes;

first connecting means for selectively connecting each of said display segmented electrodes into one of two groups, depending on a display pattern to be indicated;

counting means for counting the display segmented electrodes in at least one group and determining the difference in display area between the two groups of display segmented electrodes;

second connecting means responsive to said counting means for connecting each of said first additional electrodes into one of the two groups of the display segmented electrodes;

power supply means for supplying power to each of the two groups of the first additional electrodes and display segmented electrodes; and a second additional electrode for keeping the total amount of charge for coloring the display electrodes constant.

2. The device of claim 1, wherein said second additional electrode comprises a film.

3. The device of claim 1, wherein said second additional electrode comprises a mixture of a powder of an active material and another powder of a conductor.

4. The device of claim 3, wherein said powder of a conductor comprises expanded graphite or active carbon.

5. The device of claim 1, further comprising third connecting means for connecting said second additional electrode with either of the two groups of the first additional electrodes and display segmented electrodes.

6. The device of claim 5, further comprising second power supply means for supplying a constant voltage between said second additional electrode and either of the two groups of the first additional electrodes and display segmented electrodes.

7. The device of claim 1, wherein said second additional electrode comprises material selected from the group comprising:

(1) Mg, Al, Zn, Cr, Fe, Ni, Sn, Pb, Tl, Ti, Zr, Cd and In;

(2) $NiF_2$, $NiCl_2$, $CuF_2$, $CuCl_2$ and AgCl;

(3) $WO_3$, CuS, CuSe, FeS, FeSe, MoOx, WOx (wherein x is more than 1 and not more than 3), tungsten bronze, and $Nb_2Ox$ (wherein x is more than 2 and not more than 5); and (4) RFe(II) [Fe(III) $(CN)_6$] (in which R is $NH_4$, H, K or Na).

* * * * *

UNITED STATES PATENT AND TRADEMARK OFFICE

CERTIFICATE OF CORRECTION

PATENT NO. : 4,399,436

DATED : August 16, 1983

INVENTOR(S) : Hamada et al

It is certified that error appears in the above-identified patent and that said Letters Patent are hereby corrected as shown below:

In the Heading of the Patent, in the category "[73] Assignee:", delete "Hiroshi Hamada, Osaka, Japan" and insert --Sharp Kabushiki Kaisha, Osaka, Japan--.

Signed and Sealed this

*Twentieth* Day of *March 1984*

[SEAL]

*Attest:*

*Attesting Officer*

GERALD J. MOSSINGHOFF

*Commissioner of Patents and Trademarks*